US007136089B2

(12) United States Patent
Able et al.

(10) Patent No.: US 7,136,089 B2
(45) Date of Patent: Nov. 14, 2006

(54) DYNAMIC TIME TO FIRST PRINT SELECTION

(75) Inventors: Douglas Anthony Able, Shelbyville, KY (US); David John Mickan, Lexington, KY (US); Kevin Dean Schoedinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 366 days.

(21) Appl. No.: 10/763,026

(22) Filed: Jan. 22, 2004

(65) Prior Publication Data

US 2005/0162453 A1 Jul. 28, 2005

(51) Int. Cl.
*B41J 2/435* (2006.01)
*G03G 15/00* (2006.01)

(52) U.S. Cl. ..... 347/262; 347/264; 399/43

(58) Field of Classification Search ..... 347/231, 347/240, 243, 251, 259–261, 229, 234–237, 347/247–250, 262, 264; 399/82, 43, 322; 385/1.15

See application file for complete search history.

(56) References Cited

U.S. PATENT DOCUMENTS

| | | | | |
|---|---|---|---|---|
| 6,240,264 | B1 * | 5/2001 | Yajima et al. | 399/82 |
| 6,570,604 | B1 | 5/2003 | Able et al. | |
| 6,785,484 | B1 * | 8/2004 | Nishiyama | 399/68 |
| 2002/0181013 | A1 * | 12/2002 | Dunlao | 358/1.15 |

* cited by examiner

*Primary Examiner*—Hai Pham
(74) *Attorney, Agent, or Firm*—King & Schickli

(57) ABSTRACT

The number of pages of a print job received at printer (10) is determined (256). If the number of pages is low, printing is conducted at intermediate speed (262). If the number of pages is higher, printing is conducted at high speed (254). If the number of pages is not known, a default is selected (260). The default often will be to print at intermediate speed because most jobs are short. If high speed printing is in progress when a job is received, the next job is printed at high speed (254). Alternatively, a predetermined number of the first pages of a job may be printed at intermediate speed.

18 Claims, 4 Drawing Sheets

DYNAMIC TIME TO FIRST PRINT SELECTION

TECHNICAL FIELD

This invention relates to printers that require some tangible time between nonprinting status and actual marking on paper or other media. More specifically, this invention relates to improving the time to begin printing the first sheet of a job, which can also reduce the overall printing time for short print jobs.

BACKGROUND OF THE INVENTION

In laser printers of today, time to first print is often limited to the printhead lock time, which is the time period provided to permit the rotating printhead mirror to reach printing speed. Printhead lock is simply the stable operation of the laser printhead at a predetermined speed, and printhead lock time is the time period from start from inactive or partially active to assure printhead lock.

Moreover, some printers are operating at increasingly higher speeds, and such higher speeds require longer times to reach lock. Conventional imaging devices print jobs of a predetermined kind, such as ordinary text printing, at the maximum speed of the printer for such printing. This invention achieves reduced printing time by not printing certain jobs at the maximum speed of the imaging device for such printing.

DISCLOSURE OF THE INVENTION

In accordance with this invention, short print jobs (normally one to ten or more pages depending on the timing of the actual printer, jobs of up to three or four pages in the embodiment disclosed in detail) are printed at a lower speed than the maximum speed that the printer could print such a job. This results in faster time to first print and potentially faster overall printing time because the printhead speed lock time is materially reduced.

By printing at an intermediate speed, the printer can be ready to begin imaging sooner (due to factors such as printhead speed lock) than it would be ready at max speed. When the job size is small, the time improvement from the quicker readiness can be greater than the time that is lost due to slower media movement. This results in the job being completed in less overall time.

The number of pages in a print job is normally included in the heading data of the print job. At times this may be entered from an operating panel. In the instance where the number of pages in a job can not be extracted from the circumstances, the printer preferably has a default mode in which either the slower printing for all jobs is conducted or the faster printing for all jobs is conducted. The default may be selected as either the lower speed or the high speed. Since short jobs are common, often the default to lower speed will be preferred.

When a job of length for high speed printing is received, the transfer to higher speed is preferably made after a preceding job is completed, as the change in speed might vary somewhat the appearance of the printing.

BRIEF DESCRIPTION OF THE DRAWINGS

The details of this invention will be described in connection with the accompanying drawings, in which.

DESCRIPTION OF THE EMBODIMENTS

Figure 1:
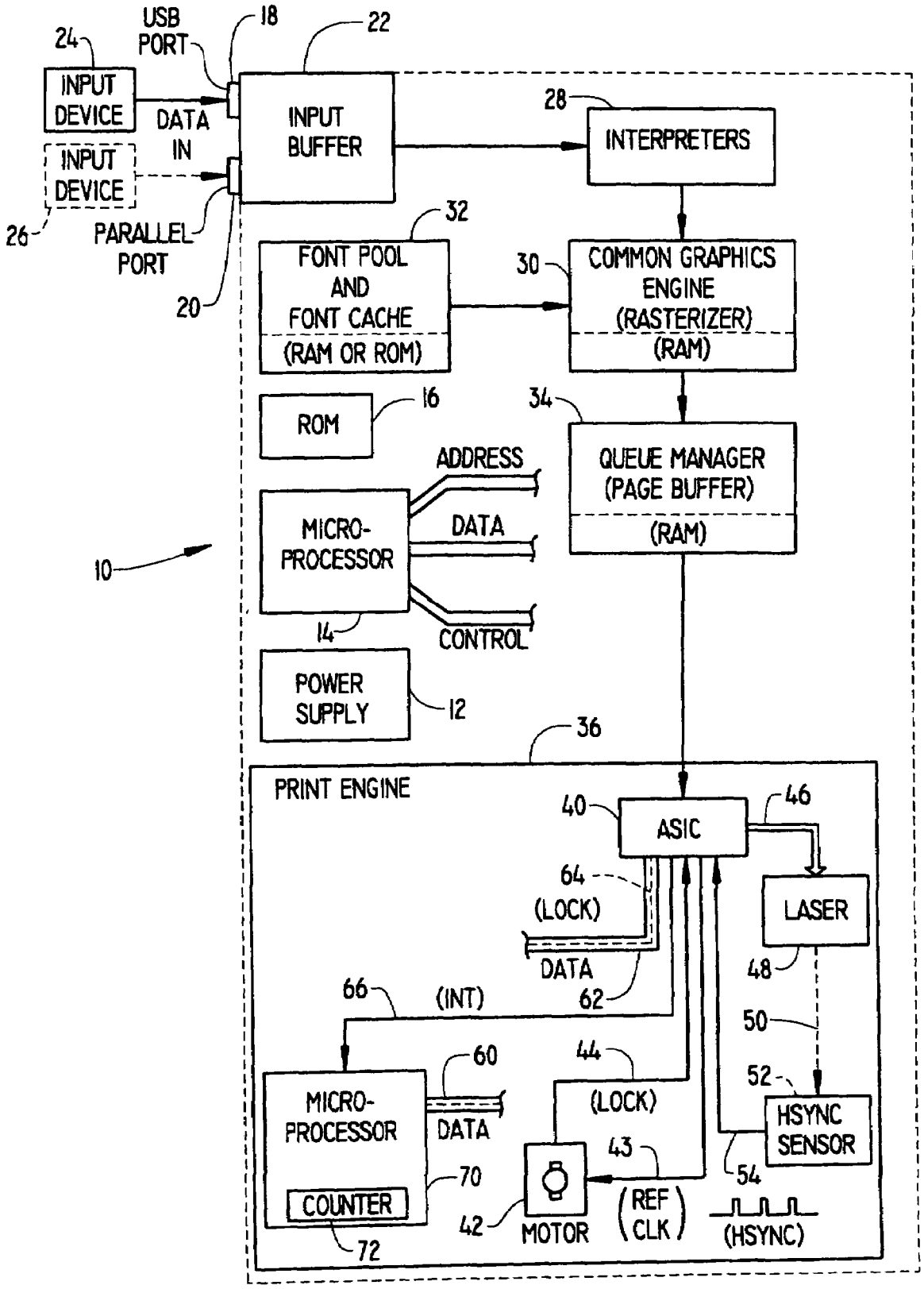
FIG. 1 is a hardware block diagram of the major components used in a laser printer which may incorporate this invention.

Printing System:

Referring now to the drawings, FIG. 1 shows a hardware block diagram of a laser printer generally designated by the reference numeral 10. Laser printer 10 will preferably contain certain relatively standard components such a DC power supply 12 which may have multiple outputs of different voltage levels, a microprocessor 14 having address lines, data lines and control and/or interrupt lines. Read Only Memory (ROM) 16, and Random Access Memory (RAM), are divided into several portions for performing several different functions.

Laser printer 10 will typically contain at least one network input (not shown), parallel input or USB port, or in many cases two or more types of input ports, so designated by the reference numeral 18 for the USB port and the reference numeral 20 for the parallel port. Each of these ports 18 and 20 would be connected to a corresponding input buffer, generally designated by the reference number 22 on FIG. 1. USB port 18 would typically be connected to a USB output port of a personal computer or a workstation that would contain a software program such as a word processor or a graphics package or computer aided drawing package. Similarly, parallel port 20 could also be connected to a parallel output port of the same type of personal computer or workstation containing the same type of programs, only the data cable would have several parallel lines. Such input devices are designated, respectively, by the reference numerals 24 and 26 on FIG. 1.

Once the text or graphical data has been received by input buffer 22, it is commonly communicated to one or more interpreters designated by the reference numeral 28. A common interpreter is PostScript™, which is an industry standard used by most laser printers. After being interpreted, the input data is typically sent to a common graphics engine to be rasterized, which typically occurs in a portion of RAM designated by the reference numeral 30 on FIG. 1. To speed up the process of rasterization, a font pool and possibly also a font memories are designated by the reference numeral 32 on FIG. 1. Such font pools and caches supply bitmap patterns for common alphanumeric characters so that the common graphics engine 30 can easily translate each such character into a bitmap using a minimal elapsed time.

Once the data has been rasterized, it is directed into a queue manager or page buffer, which is a portion of RAM, designated by the reference number 34. In a typical laser printer, an entire page of rasterized data is stored in the queue manager during the time interval that it takes to physically print the hard copy for that page. The data within the queue manager 34 is communicated in real time to a print engine designated by the reference numeral 36. Print engine 36 includes the laser light source within the printhead, and its output results in physical inking onto a piece of paper, which is the final print output from laser printer 10.

It will be understood that the imaging device might receive data from a scanner (not shown) or by facsimile, and therefore not need some of the image processing elements discussed in the foregoing.

It will be understood that the address, data and control lines are typically grouped in buses, and which are physically communicated in parallel (sometimes also multiplexed) electrically conductive pathways around the various electronic components within laser printer 10. For example, the address and data buses are typically directed to all input or output integrated circuits that act as buffers.

Print engine 36 contains an ASIC (Application Specific Integrated Circuit) 40, which acts as a controller and data manipulating device for the various hardware components within the print engine. The bitmap print data arriving from Queue Manager 34 is received by ASIC 40, and at the proper moments is sent via signal lines 46 to the laser, which is designated by the reference numeral 48.

ASIC 40 controls the various motor drives within the print engine 36, and also receives status signals from the various hardware components of the print engine. A motor 42 is used to drive the faceted mirror (see the polygonal mirror 116 on FIG. 2) and when motor 42 ramps up to a rotational speed (i.e. its "lock" speed) that is dictated or measured by the frequency of a reference signal ("REF CLK") at a signal line 43, a "Lock" signal will be enabled on a signal line 44 that is transmitted to ASIC 40.

The lock signal may be dictated or controlled by various alternatives. Where the lock speed is to be different for different applications by the same printer 10, reference frequencies are supplied to track motor 42 supporting different lock speeds at different reference frequencies. Virtually any practical means to determine when a motor is at a stabilized, predetermined speed are alternatives and many such means as well within the state of the art or may be developed in the future. For purposes of this invention lock speed equates to the speed of rotation of mirror 116 (FIG. 2) employed for actual printing of a given page of a given print job.

During conventional operation, once ASIC 40 receives the lock signal from motor 42, it transmits a corresponding lock signal (as part of a byte of a digital signal) along one of the data lines 64 of the data bus 62 that communicates with ASIC 40. Data bus 62 is either the same as the data bus 60 that communicates with microprocessor 70, or a portion thereof. (In practice microprocessor 70 and microprocessor 14 may be a single processor.) When this lock status signal is received by microprocessor 70, microprocessor 70 initiates action of printer 10 leading to printing by printer 10 in normal course.

The HSYNC signal is received from an optical sensor designated by the reference number 52 and called the HSYNC sensor. The laser light source 110 (see FIG. 2) places a spot of light on the rotating polygonal mirror 116, which then redirects the laser light so that it ultimately sweeps or "scans" across a "writing line" on a photoconductive drum (218 in FIG. 3), thereby creating a raster line of either black or white print elements (also known as "pels"). As the laser light scans to create this raster line, the laser light momentarily sweeps across HSYNC sensor 52 at the beginning of each sweep or "scan" across one of the facets of polygonal mirror 116. The laser light travels from laser 110 to the HSYNC sensor 52 along a light path, designated diagrammatically by the reference numeral 50 on FIG. 1. This produces an electrical pulse output signal from HSYNC sensor 52, which is communicated to ASIC 40 by a signal line 54.

As related above, a counter, designated by the reference numeral 72, is allowed to operate within microprocessor 70 (alternatively, counter 70 is within ASIC 40) and its value is saved every time a signal is received over the control line 66. By use of the different values of the count taken at each interrupt, microprocessor 70 (alternatively, ASIC 40) can determine the frequency of HSYNC signal.

Figure 2:
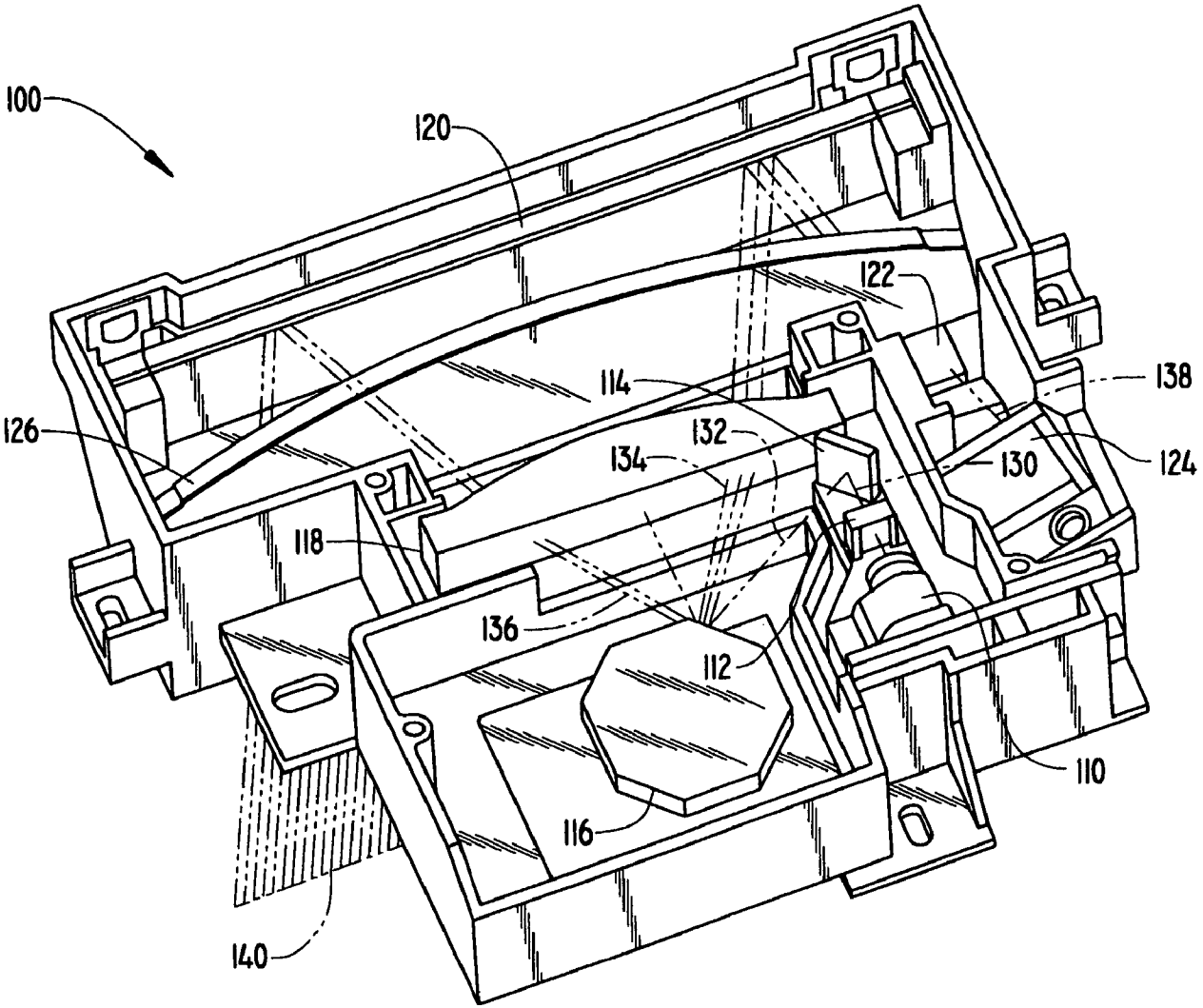
FIG. 2 is a perspective view in partial cut-away of a laser printhead particularly showing the details of the light pathways from the laser to the HSYNC sensor.

FIG. 2 provides a perspective partially cut-away view of some of the major components of a printhead 100 of laser printer 10. Starting at the laser light source 110, the light travels through a lens 112 along a pathway 130 and is redirected by a "pre-scan" mirror 114. The redirected light path, designated by a reference numeral 132, puts a spot of light on an eight-sided polygonal mirror 116. Some of the other major optical components within laser printer 10 include a lens 118, a "post-scan" fold mirror 120, a "start of scan" mirror 122, an optical sensor mounted to an HSYNC sensor card 124, and another lens 126 that directs the light into a "writing line" designated by reference 140.

After the laser light leaves the laser source 110, it is focused by lens 112 into a narrow beam that follows light path 130, before arriving at the pre-scan mirror 114. This mirror redirects the light into a path 132 which strikes a spot on the polygonal mirror 116. As mirror 116 rotates (due to motor 42), the reflected laser light is swept by one of the facets of mirror 116 from a starting position for each raster scan at the reference number 134, to an ending position of the raster scan at the reference numeral 136. The ultimate goal is to sweep the laser light across a photoconductive drum (not shown), thereby creating a series of parallel light paths as "writing lines" and designated by reference numeral 140. To achieve this writing line 140, the swept laser light is directed through lens 118 and reflected in a downward direction the fold mirror 120. The final lens 126 is used to provide the final aiming of the swept light that creates writing line 140.

A portion of the swept light that creates each raster scan is aimed by the polygonal mirror 116, lens 118, fold mirror 120, and a "start of scan" mirror 122 to create a light signal that follows the path designated by the reference numeral 138. Light that ultimately travels along path 138 will be directed to impact an optical sensor on the HSYNC sensor card 124, and the optical sensor is equivalent to the HSYNC sensor 52 seen on FIG. 1. In FIG. 2 since there are eight (8) facets or sides to polygonal mirror 116, each one-eighth rotation of mirror 116 will create an entire swept raster scan of laser light that ultimately becomes the writing line 140. For a small instant at the start of each of these scans, there will be a light beam that travels along path 138 to impact the HSYNC sensor 52 on the HSYNC sensor card 124. This HSYNC signal will be created during each scan at all times during normal operation of laser printer 10 when laser source 110 and motor 42 are running during a printing operation, even during scans in which there are no pels to be printed on the photoconductive drum in that scan. Laser source 110 is controlled such that it will produce no light at all for raster lines that are to be left blank on the final printed page, except for a brief moment at the end of each scan, so that the HSYNC signal will be produced at the beginning of each successive scan.

Figure 3:
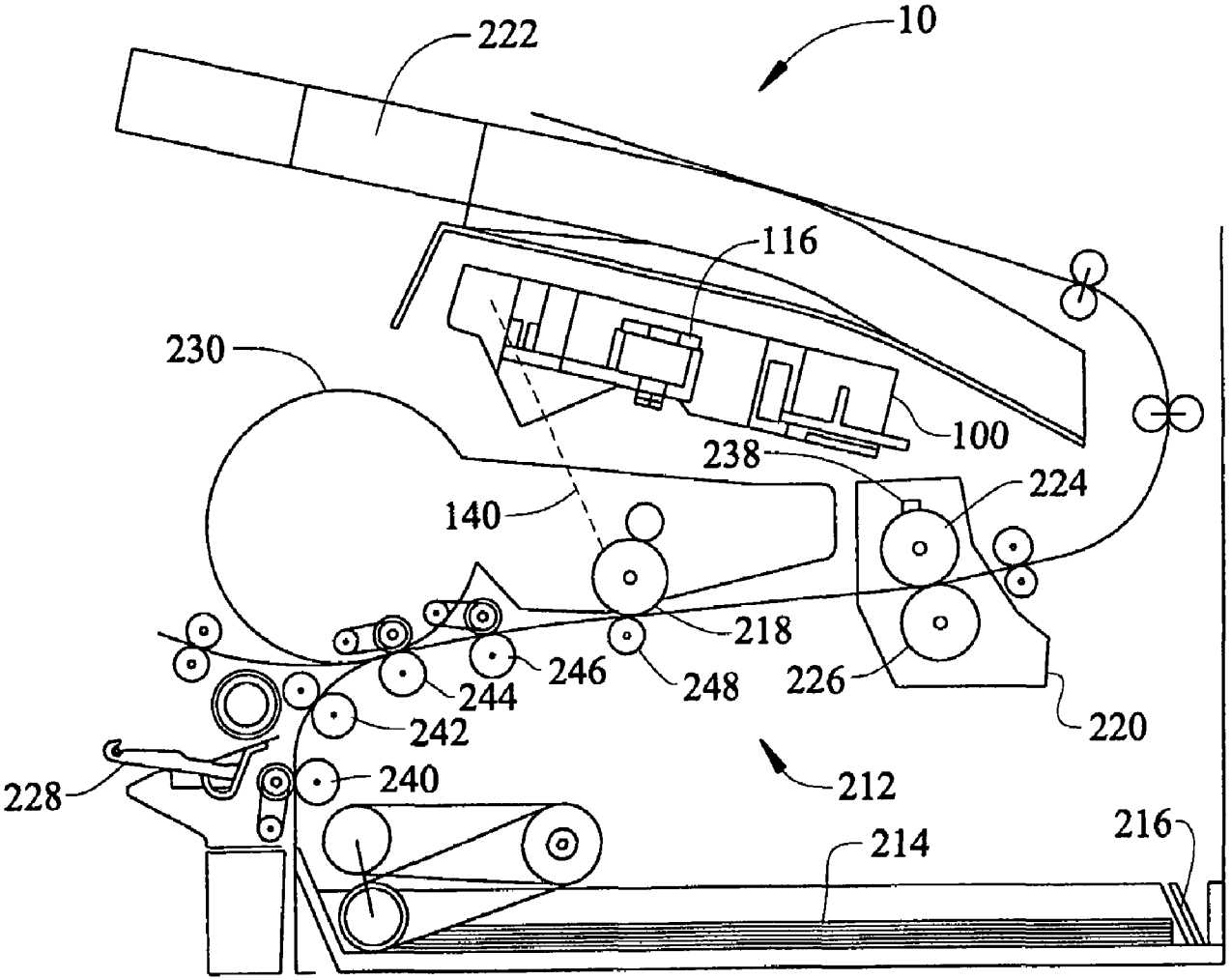
FIG. 3 is a cutaway, diagrammatic side view of major hardware elements of an illustrative laser printer which may incorporate this invention.

FIG. 3 illustrates major structural aspects of a representative printer 10. Printer 10 includes a media feed path 212 for feeding sheets of media 214, such as paper, from media tray 216 past a photoconductive drum 218 and a fuser assembly 220 to an output tray 222. The fuser assembly 20 may be a nip roller fuser formed by a fuser roller 224, which is heated to a relatively high temperature to fuse particles of toner to the sheets of media 214, and a backup roller 225.

Special media, such as envelopes, transparencies or checks, are fed into the media feed path 212 from an external, front-option tray 228, sometimes referred to as a multi-purpose tray. Photoconductive drum 218 forms an integral part of a replaceable toner cartridge 230 inserted in the printer 10.

Printhead 100 is disposed in the printer 10 for scanning the photoconductive drum 218 with a laser beam 140 to form a latent image thereon. The laser beam 140 sweeps or "scans" across a "writing line" on the photoconductive drum 218, thereby creating, in a black and white laser printer, a raster line of either black or white print elements.

A plurality of rollers 240, 242, 244, 246, 248 function in a known manner to transfer the sheets of media 214 from the media tray 216 or multi-purpose tray 228 through the media feed path 212. As is entirely standard, the paper or other media 214 receives the toner image from drum 218 and advances into the nip of fuser roller 224 and backup roller 226, where the toner image is fixed to the media 214 by being fused with heat. A thermistor 238 or other heat sensor senses the temperature of the fuser 220, typically by being in contact with the fuser roller 224. This temperature information is communicated to microprocessor 70 (FIG. 1) and microprocessor 70 controls power to a heating element (not shown) in or near the fuser roller to control the temperature. Such control of fuser temperature is widely practiced in various forms, and any such control is consistent with this invention.

When mirror motor 42 is inactive, the time to reach printing speed can be much longer than the time to feed media 214 to the photoconductor drum 218. Accordingly, it is standard to delay printing until mirror motor 42 reaches a predetermined speed consistent to being ready to complete printing when media 214 contacts drum 218. Similarly, when fuser 220 is cool or only moderately warm, the time to reach fixing temperature can be much longer than the time required to convey media from media tray 216 to the fuser 220. Accordingly, it is common both to maintain fuser 220 at high intermediate temperature (which is often termed a standby mode) and to delay printing as necessary.

To practice this invention, normally the mirror 116 will be supported for rotation on a bearing (not shown) that is subject to virtually no wear during rotation, such as an air bearing. As the rotation of any mirror motor requires power and procedures some sound, which may be distracting, the mirror is not kept at full speed during an inactive period.

To preserve power at the fuser, the temperature at the heater is reduced soon after the print job is completed at the fuser. This intermediate, lower temperature is selected to ensure that the fuser can be heated to reach the fixing temperature by the time a sheet of media reaches the fuser.

Accordingly, a standby condition is created in which the rotation speed of the mirror motor is reduced substantially. In the illustrative printer 10 that speed may be reduced from 52,000 revolutions per minute to 25,000, and the power to the laser is removed to deactivate the laser. The fuser temperature is reduced a moderate amount. In the illustrative printer 10 the reduction in this standby condition may be from 206 degrees C. to 180 degrees C.

The 52,000 revolutions per minute speed is the speed for high-speed printing. The 25,000 speed is a standby speed between the 52,000 speed and very low or off, but is less that the speed for intermediate speed printing. Accordingly, some time is required for the 25,000 speed to be increased to the speed for intermediate speed printing.

A print job initiated during this standby condition is delayed significantly. This standby condition may be continued for some as both power consumption and sound production is significantly low. A typical period to maintain this standby condition is about 60 minutes. Longer periods for this standby condition are sometimes preferred and are employed. The period may be only a few minutes for certain users, but is normally much higher.

After a certain period of time without a print job, the mirror motor is stopped (or, if practical, reduced to very slow rotation) and the fuser temperature is further reduced or the fuser is no longer heated at all. In a system consistent with the foregoing, the temperature may be reduced to 175 degrees C.

The turning off (or very slow rotation) of the mirror motor with a low fuser temperature constitutes another standby condition, which is standard in itself.

The foregoing is implemented by microprocessor 70 or equivalent electronic control logic such as by an ASIC. Such control, in itself, may employ existing printing systems, as discussed with respect to the illustrative embodiment 10 of FIGS. 1–3.

In the practice of this invention, the imaging device, for which the printer of FIGS. 1–3 is illustrative, prints at a first, intermediate speed, and a second, higher speed. (The printer being capable of other speeds is consistent with this invention.)

When a print job is received, microprocessor 70 or other device electronic control is normally explicitly informed from the data in the print job of the number of pages in the print job. Similarly, such information might be entered by an operator of the imaging device directly or through a network connection to the imaging device. Alternatively, the electronic control might derive the number of pages from the content of the print job.

In accordance with this invention, when the print job has few pages such that the lock time to the rotation speed for the higher speed printing would delay overall printing of the job, the job is printed at the intermediate speed.

If the imaging device receives a long print job during operation of such a short job, a transition to high speed printing might be begun with the next page. However, this might cause pages in the same job to have a slightly different overall appearance. Accordingly, normally the imaging device is controlled to finish the short job at the intermediate speed and then pause to increase the mirror motor speed and increase the fuser temperature and then print at the higher speed.

In those instances in which the number of pages in a print job is not known, such as when the electronic controls do not recognize the size or the job end is not specified early in the print job data, a default status to printing at the intermediate speed would often be preferred because most jobs are short. A second default status is printing such jobs at the high speed. Selection of the default would normally be by factory setting and by operator input from a control panel as is generally conventional, and could be by other methods as by a network input controlled by a network administrator as is generally conventional.

Figure 4:
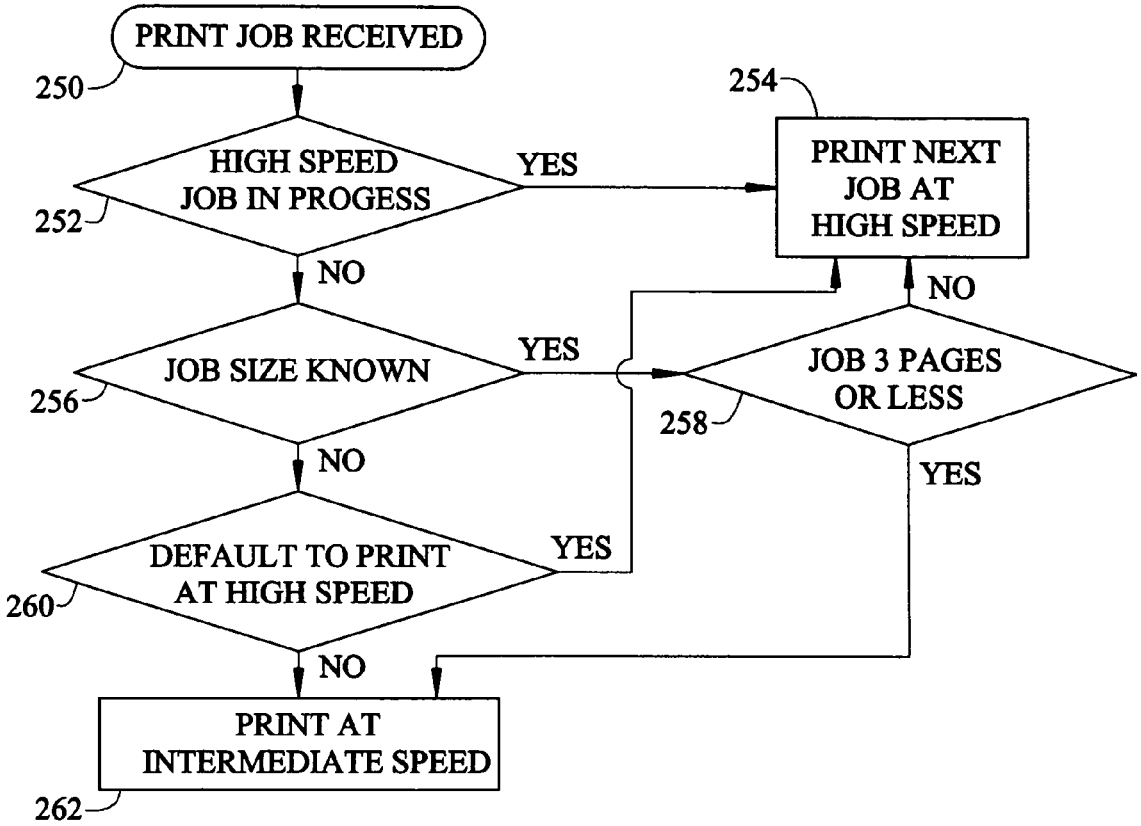
FIG. 4 is a flow diagram illustrating the operation of this invention.

A more specific illustration of the overall flow of this invention will be discussed in connection with FIG. 4. This invention is initiated by the receipt of a print job, illustrated by action 250. Decision 252 then determines if a high speed print job is in progress. If yes, action 254 causes printing of the next job at high speed.

When decision 252 is no, decision 256 determines if the job size is known. If yes, decision 258 determines if the job is 3 pages or less in size. If no, the job is printed at high speed by action 254.

If decision 256 is no, decision 260 then determines whether the default is print at high speed. If decision 260 is yes, action 254 to print at high speed is activated. After printing at high speed, further activity with respect to this invention does not occur until a subsequent print job is received at action 250.

If decision 260 is no or decision 258 is yes, action 262 to print at intermediate speed is activated. Control flow with respect to this invention is then ended until a next print job is received by action 250.

In accordance with this, an intermediate speed job followed by a short job is printed without delay at intermediate speed, which normally saves overall print time.

Alternately, all initial sheets up to a predetermined number would be printed at the intermediate speed. Sheets more than said predetermined number would be printed at the high speed. This might sacrifice print consistency between pages in the long print jobs, but would save time for printing short jobs.

Figure 5:
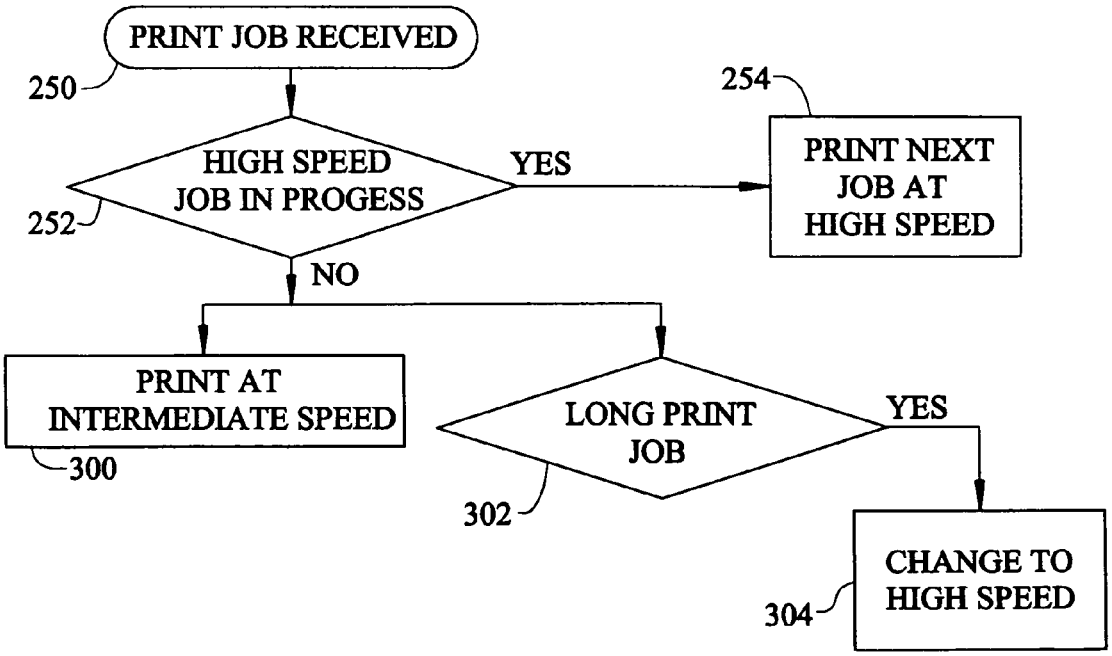
FIG. 5 is a flow diagram illustrating an alternative of this invention

This alternative is illustrated in FIG. 5. It is initiated by the receipt of a print job, action 250. Decision 252 then determines if a high speed job is in progress. If yes, action 254 causes printing of the next job a high speed.

When decision 252 is no in this alternative, printing is begun at intermediate speed in action 300 without regard to the length of the print job. Previously or subsequently, the size of the print is determined in decision 302. (This can be by methods described in the foregoing or by counting pages as they are printed.)

If decision 302 finds a long print, such as at least three pages, decision 302 is yes, which initiates action 304. Action 304 is to print at high speed. When decision 302 is no, action 300 continues until the short print job is completed. Control flow with respect to this alternative is then ended until a next print job is received by action 250. At least the first sheet of a print job started from standby or off will be printed at intermediate speed.

Although the first alternative may define the short print job to a number to increase overall job speed (3 or 4 pages being representative for this purpose) the short job may be defined so as to sacrifice overall speed slightly to provide faster first pages. This is useful where a user wishes to review a first page as soon as possible. The second alternative necessarily provides the first page with minimum delay.

What is claimed is:

1. An imaging device capable of printing at an intermediate speed and at a high speed, said imaging device having electronic control to:

determine the number of sheets to be printed by print jobs received by said imaging device, and operate said imaging device at said intermediate speed when said number of sheets determined is a predetermined number of sheets or less and operate said imaging device at a high speed when said print job is more than said predetermined number.

2. The imaging device as in claim 1 in which said imaging device employs a rotating scan mirror to scan light over a photoconductor to create an electrostatic image and said scan mirror is rotated at a speed less than the speed for said printing at intermediate speed during standby periods between print jobs.

3. The imaging device as in claim 2 in which said predetermined number of sheets is at least one.

4. The imaging device as in claim 3 in which said imaging device may be set to a first default status which prints jobs at said intermediate speed for jobs for which the number of pages of the job is undetermined and may be set to a second default status which prints jobs at said high speed for jobs for which the number of pages of the job is undetermined.

5. The imaging device as in claim 4 in which said electronic control continues printing of a first print job being printed at intermediate speed and changes to high speed printing for a second print job received when first print job is being printed at the end of printing of said first print job at intermediate speed.

6. The imaging device of claim 3 in which said electronic control continues printing of a first print job being printed at intermediate speed and changes to high speed printing for a second print job received when first print job is being printed at the end of printing of said first print job at intermediate speed.

7. The imaging device as in claim 2 in which said imaging device may be set to a first default status which prints jobs at said intermediate speed for jobs for which the number of pages of the job is undetermined and may be set to a second default status which prints jobs at said high speed for jobs for which the number of pages of the job is undetermined.

8. The imaging device as in claim 7 in which said electronic control continues printing of a first print job being printed at intermediate speed and changes to high speed printing for a second print job received when first print job is being printed at the end of printing of said first print job at intermediate speed.

9. The imaging device of claim 2 in which said electronic control continues printing of a first print job being printed at intermediate speed and changes to high speed printing for a second print job received when first print job is being printed at the end of printing of said first print job at intermediate speed.

10. The imaging device as in claim 1 in which said predetermined number of sheets is at least one.

11. The imaging device as in claim 10 in which said imaging device may be set to a first default status which prints jobs at said intermediate speed for jobs for which the number of pages of the job is undetermined and may be set to a second default status which prints jobs at said high speed for jobs for which the number of pages of the job is undetermined.

12. The imaging device as in claim 11 in which said electronic control continues printing of a first print job being printed at intermediate speed and changes to high speed printing for a second print job received when first print job is being printed at the end of printing of said first print job at intermediate speed.

13. The imaging device as in claim 10 in which said electronic control continues printing of a first print job being printed at intermediate speed and changes to high speed printing for a second print job received when first print job is being printed at the end of printing of said first print job at intermediate speed.

14. The imaging device as in claim 1 in which said imaging device may be set to a first default status which prints jobs at said intermediate speed for jobs for which the number of pages of the job is undetermined and may be set to a second default status which prints jobs at said high speed for jobs for which the number of pages of the job is undetermined.

15. The imaging device as in claim 14 in which said electronic control continues printing of a first print job being printed at intermediate speed and changes to high speed printing for a second print job received when first print job is being printed at the end of printing of said first print job at intermediate speed.

16. The imaging device as in claim 1 in which said electronic control continues printing of a first print job being printed at intermediate speed and changes to high speed printing for a second print job received when first print job is being printed at the end of printing of said first print job at intermediate speed.

17. An imaging device capable of printing at an intermediate speed and at a high speed said imaging device having electronic control to:

operate said device at said intermediate speed when said imaging device initiates printing, determine that more than a predetermined number of sheets more than one sheet is part of a print job being printed at said intermediate speed, and change operation from said intermediate speed to said high speed in response to said determination of more than a predetermined number of sheets after printing at least one sheet.

18. The imaging device of claim 17 in which said change operation to high speed is after printing at least three sheets.

* * * * *